US006251468B1

(12) United States Patent
Balter

(10) Patent No.: US 6,251,468 B1
(45) Date of Patent: Jun. 26, 2001

(54) METHOD OF MASKING A SURFACE FROM COATING WITH A SOLID MASKANT AND COATING DISPENSER

(76) Inventor: Lennart Balter, Ankarsrum (SE)

( * ) Notice: Subject to any disclaimer, the term of this patent is extended or adjusted under 35 U.S.C. 154(b) by 0 days.

(21) Appl. No.: 09/463,750

(22) PCT Filed: Jul. 27, 1998

(86) PCT No.: PCT/SE98/01416

§ 371 Date: Jan. 27, 2000

§ 102(e) Date: Jan. 27, 2000

(87) PCT Pub. No.: WO99/07483

PCT Pub. Date: Feb. 18, 1999

(30) Foreign Application Priority Data

Jul. 28, 1997 (SE) ..... 9702810

(51) Int. Cl.[7] ..... B05D 1/26; B05D 1/32; B05C 11/00; B43K 21/00

(52) U.S. Cl. ..... 427/11; 427/154; 427/282; 118/76; 401/82

(58) Field of Search ..... 427/11, 154–156, 427/282; 118/504, 76, 200; 401/82–84

(56) References Cited

U.S. PATENT DOCUMENTS

| | | | | |
|---|---|---|---|---|
| 3,969,025 | * | 7/1976 | Brodie | 401/2 |
| 4,315,957 | * | 2/1982 | Hereth et al. | 427/155 |
| 4,652,163 | * | 3/1987 | Karliner et al. | 401/195 |
| 5,618,582 | * | 4/1997 | VanWickel | 427/259 |

* cited by examiner

*Primary Examiner*—Brian K. Talbot
(74) *Attorney, Agent, or Firm*—Hovey, Williams, Timmons & Collins

(57) ABSTRACT

A masking member including a substance provided to be deposited onto a surface in order to mask the latter, and protect it from outer affection, the substance being provided to be deposited as an easily releasable film on said surface by being brushed against said surface.

6 Claims, 1 Drawing Sheet

METHOD OF MASKING A SURFACE FROM COATING WITH A SOLID MASKANT AND COATING DISPENSER

BACKGROUND OF THE INVENTION

1. Field of the Invention

The present invention relates to a masking means comprising a substance provided to be deposited onto a surface in order to mask the latter, and protect it from outer affection.

Such masking means are widely used during painting of various objects. Thereby, the masking has as its main objective to protect against any outer affection by preventing colour from being applied to adjacent surfaces that are not to be painted. Masking is normally required during the painting of houses, furniture, cars, boats, etc., and it is important that the masking means used are both reliable and easy to handle.

2. Description of the Prior Art

A very common masking means is masking tape, which in its most simple form is formed by a paper which is provided with glue on one side thereof. There are also more sophisticated types of masking tapes, where the glue is present only along the edge regions of the tape or where a strip or the like provided with glue is applied to the egde regions of a masking tape as the latter is applied to the surface which is to be masked. There are also variousl, more or less sophisticated devices for the application of the masking tape.

In those cases, when a precise masking of surfaces that have a complicated shape is required, it may, however, often be difficult to mask these surfaces with reliability and precision by means of conventional masking tapes. Thereby, one normally uses different types of templates, from which a surface corresponding to the one which is to be painted is, for instance, cut or sheared, after which the template may be placed at the intended location, and painting may subsequently take place. It is important that the template bears tightly against the support at Its border towards the surface which is to be painted, in order to prevent paint from penetrating in between the support and the template. Therefore, the template often needs to be provided with some kind of adhesive or in some other way be brought to a tight contact against the support. This contributes to make the practical handling of such templates somewhat complicated and/or time demanding. In those cases when one side of the template is pre-preparated with some type of adhesive, the template also tends to be of a disposable type, which in many cases results in a huge consumption of material, as it might be neccessary to use a plurality of templates. Moreover, templates, as well as masking tape, may be very hard to apply to curved surfaces in a suitable way. For this purpose, there is often required a very precise adjustment of the template or the masking tape, which might be both difficult and time demanding, particularly for an amateur.

Those more developed types of tapes, application devices and templates that are to be found at the market today are relatively expensive, resulting in the additional cost for these not being seen as motivated by the one who, with a non-professional objective, is planning to paint and mask surfaces.

SUMMARY OF THE INVENTION

One object of the present invention is to provide a masking means which can be applied by very simple measures to a surface which is to be masked and protected, which can easily be removed from the surface when no longer needed, which is not material or resource demanding, and offers a inexpensive and uncomplicated alternative to the masking means of prior art. By protection, a shielding of the surface from an adhesive, preferably lacquer or paint, is referred to.

This object is fulfilled by means of the masking means as initially defined, which is characterised in that the substance is provided to be deposited as an easily releasable film on said surface by being brushed against said surface.

According to a preferred embodiment of the masking means, the substance is present in a generally solid state. Thereby, painting is permitted immediately or nearly immediately after the substance has been deposited and formed a solid masking film on its support. The handling of the masking means, or more precisely the substance, is also facilitated as the latter is present in a solid state without practically any tendency to being sticky. This condition preferably is true for temperatures in the order of room temperature, somewhat thereabove and therebelow, for example below 40° C. However, under any circumstances, the substance should be sufficiently soft to be deposited onto the support through abrasion and/or affinition thereto when being brushed thereagainst at the application temperature. The substance is in bulk shape, unlike tapes and the like, which is advantageous from a handling point of view as well as a productional costs point of view.

According to another preferred embodiment of the inventive masking means, it comprises a casing provided with at least one opening, inside which casing the substance is displaceably arranged in such a way that it might be brought to project with at least one portion from said opening. Thereby the handling is further facilitated, and a user may grip around the casing instead of around the substance during the application of the latter, such that the substance is not unneccessarily deposited onto the hands of the user. The risk of having it deposited onto other surfaces, that are not to be masked, is also reduced. Moreover, the casing may act as a container that prevents the substance from being mechanically damaged or the like during the storing thereof.

According to another preferred embodiment of the inventive masking means, the casing comprises at least one heel which projects from the peripheral edge of the casing around the opening and forms an elongation of said edge along at least a portion of the periphery of the opening. Preferably, the heel is an elongation of said edge and has a rectilinear extension in the peripheral direction along a portion of the periphery of the opening. The heel is advantageous because it can be used as a shoulder against a frame, a fillet or the like, which is to be painted, while, at the same time, the masking means is pulled along the frame or the fillet, and the substance, which projects generally as far away from the opening as does the heel, is brushed against the support, and is deposited at a distance from the fillet or the frame that corresponds to the width of the heel. In the case where the masking means is intended for the masking of windows in connection to the painting of windows, the width of the heel is preferably in the order of 1 mm, such that, as is usual, a thin strip of paint, in the order of 1 mm, is permitted to be deposited on the window, the fillet of which is to be painted.

According to another preferred embodiment of the masking means, the substance has the shape of a stick, and the cross-section of the surface of this stick, that is provided to bear on the surface that is to be masked, comprises at least one corner which has an angle that is less than or generally equal to 90°. Thereby, it is easier to reach into corners with the substance during the application thereof, something that often, for instance in the above case concerning the painting of frames and fillets, is of utmost importance in order to obtain a good result. Moreover, the inner periphery of the casing preferably corresponds to the outer periphery of the stick, something that promotes an exact and precise application.

According to another preferred embodiment of the masking means, the substance comprises at least one organic compound as a substantial component, and said organic compound comprises at least one of a wax and a fat as a substantial component. Particularly the use of a wax has proven itself to be advantageous. Thanks to the content of wax and/or fat, the substance obtains hydrophobic properties which make it water rejective, and thereby water resistant. Thereby, it may form a film which resists the penetration of water-based paint. The substance also obtains such properties that it is not dissolved by solvent-based paints and lacquers, and, accordingly, it forms a functional masking film also during painting with such paints. Furthermore, fat and wax in a solid state permit themselves to be easily deposited through brushing against a support, while, at the same time, they may provide the substance with such hardness that it stands the mechanical affection that it is subjected to by painting tools, such as brushes and rollers. A solid wax or fat is also easily scraped away by means of a scraping tool during a subsequent demasking. Rests of the substance that still remain may be easily removed by washing with hot water (in the range of 50° C.), preferably with a small addition of a washing agent and with the aid of a sponge or the like, remaining wax and fat thereby being melted and easily absorbed by means of the sponge.

According to another preferred embodiment of the masking means, the wax comprises an alcane with a molecule formula of approximately $C_{20}H_{42}$ or higher as a substantial component. Such alcanes are normally named paraffin wax, they are easy to produce and, accordingly, inexpensive. Suitably, paraffin wax of the kind used in so called heating candles may be used as a substantial component in the inventive substance.

According to another preferred embodiment of the masking means, the substance comprises an alcane with a molecule formula generally within the range of $C_{13}H_{28}$ to $C_{19}H_{40}$ as a softening component. Within this range, this paraffin is liquid to semi-solid and it is easily commercially available under the commercial name vaseline. The use of such a liquid or semi-solid paraffin contributes to making the substance slightly softer than if only a harder wax or fat is used, and renders the substance a better ability to attach against, for instance, smooth surfaces, such as glass, than if the substance only would comprise said harder wax or fat. Furthermore, a subsequent cleaning by means of hot water and a sponge or the like is facilitated.

According to another preferred embodiment of the masking means, the substance comprises at least one fatty acid, said fatty acid being stearic acid in the form of a solid mixture together with palmitine acid. This mixture is normally called stearine and it is rather hard at room temperature. Further, it is not very easy to remove by means of hot water and a sponge and should therefore normally be mixed with a harder or softer wax, such as hard or soft paraffin, in order to make the substance formed able to easily attach to a supporting surface and, during the demasking, to be easily released from said surface by means of a scraper and a subsequent rubbing with a sponge and hot water.

According to another preferred embodiment of the masking means, the substance comprises a pigment. Thanks to the appearance of the pigment, it is very easy for a user to check that the masking covers the surface which is to be masked in the way that he or she requires. It also becomes easier to establish whether a demasking has become successful or requires further measures.

Further features and advantages of the masking means according to the present invention will be presented in the following detailed description.

BRIEF DESCRIPTION OF THE DRAWING

The following detailed description of an embodiment of the masking means, shown only by way of example, shall be done with reference to the enclosed drawing, in which.

DETAILED DESCRIPTION OF A PREFERRED EMBODIMENT

Figure 1:
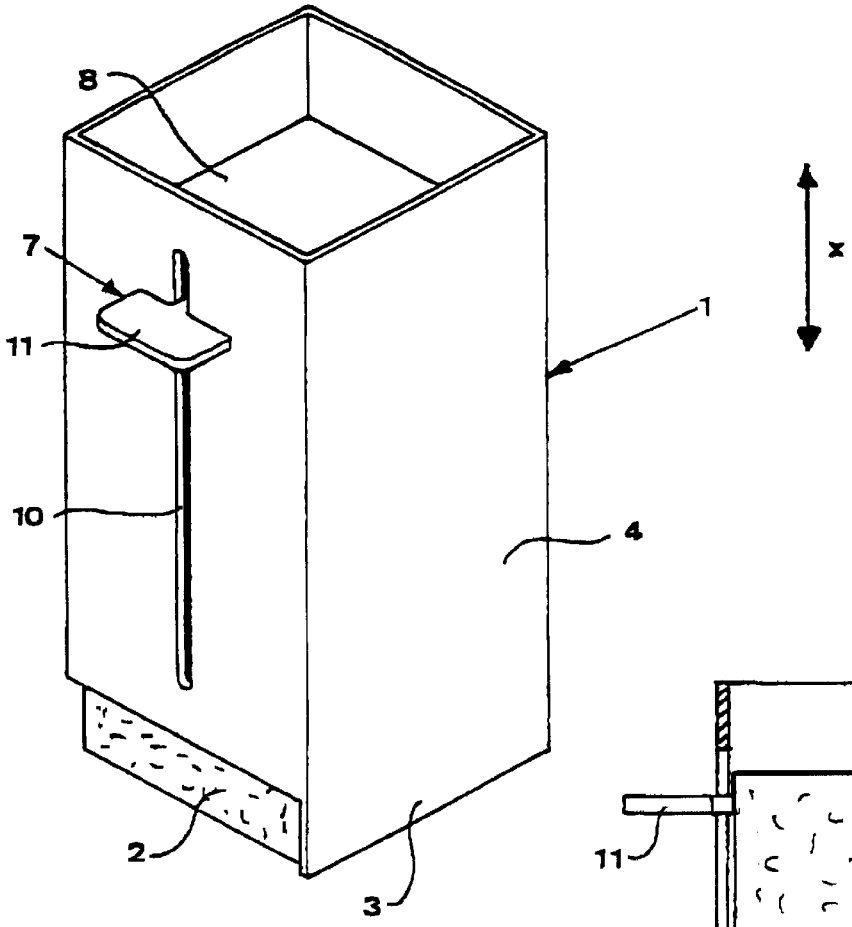
FIG. 1 shows a perspective view of the masking means, comprising a casing and the substance as provided in the shape of a stick therein.
Figure 2:
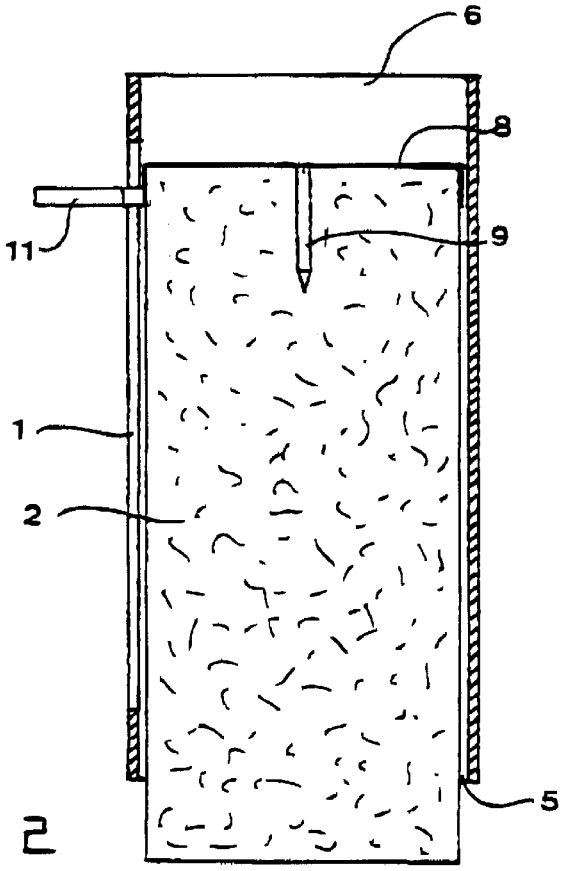
FIG. 2 shows a cross-sectional view of the masking means according to FIG. 1.

FIGS. 1 and 2 show a preferred embodiment of the inventive masking means. The latter comprises a generally rectangular casing 1 which encloses a stick 2 which is displaceably arranged in the casing 1. Also the stick 2 has a generally rectangular shape, and its outer periphery generally corresponds to the inner periphery of the casing 1.

Along one of its sides, the casing 1 comprises a heel 3 which projects from the rest of the casing and is an elongation in the lengthwise direction x of the casing 1 and of the wall 4 of the casing 1 that forms said side. The casing 1 is also provided with an opening 5, 6 in each opposite end, respectively, in the lengthwise direction x thereof. The stick 2 is arranged to be brought into the casing 1 through any of these openings 5, 6 and displaced such that it projects somewhat from one of the ends 5, 6 in order to be possible to be brushed against a support surface as the masking means is used. The masking means further comprises means 7 for displacing the stick 2 inside the casing 1. The means 7 comprise a socket 8 which is arranged inside the casing 1 and displaceable in the lengthwise direction x thereof. From the socket, a pointed projection 9 projects in said direction x. The projection 9 is adapted to engage with the stick 2 while the socket 8 encloses one 2 of the ends of the stick. Via a slot 10 which extends in said direction x, the socket 8 is connected to a support member 11 which penetrates through the slot 10. The support member 9 is arranged outside the casing 1 and may thereby be used by a user for the displacement of the stick 2 inside the casing 1 along the longitudinal axis x of the latter. However, it should be mentioned that a plurality of different alternative embodiments known per se are possible as to the displacing means 7, and that this very embodiment is not delimiting for the invention.

The stick 2 comprises a solid mixture of paraffin and stearine, a paraffin wax with a molecule chain length of $C_{20}H_{42}$ and higher preferably is present as well as a portion of semi-solid or liquid, preferably highly viscous paraffin with a molecule chain length of less than $C_{20}H_{42}$.

The amount of stearine may be in the range of 0–100% of the substance, but is preferably in the range of 20–80%, and, in the most preferred embodiment, in the range of 30–50%.

The proportion of paraffin wax may be 0–100%, but is preferably in the range of 5–70%, and, in the most preferred embodiment, in the range of 5–40%.

The proportion of soft paraffin, that is paraffin with a molecule chain length below $C_{20}H_{42}$ may be in the range of 0–90%, but is preferably in the range of 10–70%, and, most preferred in the range of 20–60%. Thereby one preferably refers to a soft paraffin of the sort which is commercially available under the commercial name vaseline.

The substance also comprises a pigment. The only task of the pigment is to bring colour to the substance, and, accordingly, the substance preferably comprises a very small proportion of pigment, for example in the range of 1%.

The preparation of the substance is performed by melting certain amounts of stearine, paraffin wax, and soft paraffin (vaseline) together, mixing them and letting them solidify to a shape corresponding to the one of the stick 2.

The below example shows how the masking means can be used.

EXAMPLE 1

The example relates to the use of the masking means during masking and painting of a round mirror. The substance comprises a mixture of 40% stearine, 10 paraffin wax, and 50% soft paraffin (vaseline).

A water-based rapidly drying paint was used for the painting. With the mirror frame as a shoulder and a support, the stick was pushed against the glass all around the mirror in such a way that a thin protective layer was deposited onto the mirror glass. Immediately after that, the painting took place. After two brushings and after that the paint finally had dried, the demasking was performed by using a cutting tool in order to cut through the paint layers along the mirror frame, after which the cutting tool was used to scrape or slice the masking away from the mirror glass. Remaining rests of masking could thereafter be washed away with hot water (50° C.) and by means of a sponge.

EXAMPLE 2

This example refers to the use of the masking means with reference to the painting of windows. The same mixture as in example 1 was used, but with an addition of 1% pigment. The masking of the window was executed in the same way as in example 1, but with the window frame as a shoulder, As the heel 3 was permitted to bear on the window closest to the window frame when the masking means was moved along the latter, a non-masked rim with a width of 1 mm was obtained on the glass along the whole inner periphery of the window frame, something that is requested in connection to the painting of window frames.

Thereinafter, the window frame could immediately be painted by means of a roller.

After that the paint had dried a ruler with a thickness of 1 mm was used as a distance member between the window frame and the cutting tool that was used in order to cut through the paint at a distance of 1 mm from the inner periphery of the window frame. Then, by means of the cutting tool, the masking and the paint layers on top thereof could easily be scraped away. Remaining rests were easily removed by means of hot water and a sponge.

EXAMPLE 3

The example refers to the use of the masking means for the masking of a linoleum floor when painting a floor fillet.

The substance comprised a mixture of 40% stearine, 30% paraffin wax, and 30% soft paraffin (vaseline), whereby a slightly thicker protective coating was obtained than in examples 1 and 2. Masking, painting, and demasking took place mainly in the same way as in example 1.

With the support in consideration, that is the linoleum floor, no particularly sharp cutting tool could, however, be used. Thereby, a slightly sharpened plastic ruler was used, which was able to cut throught the paint without making any marks in the floor surface. Thereafter, the masking could easily be scraped away from the floor surface without damaging the latter. The few masking rests that were still remaining were easily washed away by means of hot water and a sponge.

Of course, a plurality of variants and alternative embodiments of the masking means described above are obvious for a man skilled in the art without leaving the scope of the invention. The invention should therefore primarily be seen as protected with reference to what is defined in the appended claims, with support of the description and the appended drawing.

What is claimed is:

1. A method of masking a surface from receipt of a coating, said method comprising:

providing a coating dispenser including a casing provided with at least one opening and a masking substance which is displaceably received in said casing whereby at least a portion of said substance may be brought into position to project from said opening, said substance being substantially solid below about 40° C.;

wherein the casing comprises at least one heel (3) which projects from the peripheral edge of the casing around the opening (5), and forms an elongation of said edge along at least a portion of the periphery of the opening (5)

moving said casing to deposit the masking substance onto the portion of the surface to be masked by directly contacting the masking substance with the portion to deposit a protective film;

applying a coating onto the surface, including the masked portion thereof; and scraping the portion of the surface to remove the masking substance and the paint.

2. A method according to claim 1, including the step of removing any remaining portions of the masking substance by washing with water above about 50° C.

3. A coating dispenser comprising, in combination:

a masking substance to be deposited onto a surface in order to mask the latter and protect it from outer affection, said substance being in a substantially solid state at about 40° C. and provided to be deposited as an easily releasable film adapted for depositing on said surface by rubbing said substance onto said surface; and a casing receiving said substance therein and having at least one opening, said substance being displaceably arranged inside said casing whereby at least a portion of said substance may be brought in position to project from said opening wherein the casing comprises at least one heel (3) which projects from the peripheral edge of the casing around the opening (5), and forms an elongation of said edge along at least a portion of the periphery of the opening (5).

4. A coating dispenser according to claim 3, wherein the substance has the shape of a stick, and that the cross-section of a surface thereof, which is to bear against the surface to be masked, comprises at least one corner with an angle which is less than or generally equal to 90°.

5. A coating dispenser according to claim 3 wherein the substance comprises at least one organic compound as a substantial component.

6. A coating dispenser according to claim 5, characterized in that said organic compound comprises at least one of a wax and a fat as a substantial component.

* * * * *